US005303271A

United States Patent [19]

Cacciuttolo

[11] Patent Number: 5,303,271

[45] Date of Patent: Apr. 12, 1994

[54] MOVABLE CARRIER DEVICE FOR CONDUCTING ATTENDANCE WORK IN THE SECONDARY PART OF A STEAM GENERATOR OF A PRESSURIZED-WATER NUCLEAR REACTOR

[75] Inventor: Antoine Cacciuttolo, Saint-Priest, France

[73] Assignee: Framatome, Coubevoie, France

[21] Appl. No.: 957,489

[22] Filed: Oct. 7, 1992

[30] Foreign Application Priority Data

Oct. 7, 1991 [FR] France ..... 91 12321

[51] Int. Cl.[5] ..... G21C 17/00

[52] U.S. Cl. ..... 376/249; 165/69

[58] Field of Search ..... 376/249; 165/69, 162, 165/11.1

[56] References Cited

U.S. PATENT DOCUMENTS

| | | | |
|---|---|---|---|
| 3,934,731 | 1/1976 | Muller et al. | 214/1 BB |
| 4,373,855 | 2/1983 | Lebouc | 414/744 R |
| 4,590,991 | 5/1986 | Cooper, Jr. et al. | 165/69 |
| 4,661,309 | 4/1987 | Hayes | 376/248 |
| 4,788,867 | 12/1988 | Kishel | 73/722 |
| 4,919,194 | 4/1990 | Gery et al. | 165/1 |

FOREIGN PATENT DOCUMENTS 0104492 9/1983 European Pat. Off. .

*Primary Examiner*—Donald P. Walsh
*Assistant Examiner*—Meena Chelliah
*Attorney, Agent, or Firm*—Pollock, Vande Sande & Priddy

[57] ABSTRACT

The device comprises a central body carrying a first inflatable flexible head and two jacks each carrying an inflatable flexible head at its end. The rods of the jacks are oriented in two directions located on either side of the central body to assure displacement of the central body as a result of the retraction and extension of the rods of the jacks in opposite directions. In the expanded state, the inflatable flexible head are maintained by wedging in the annular space between the bundle casing and the outer casing of the steam generator. In the retracted and deflated state, the flexible heads can be displaced in the annular space. The device also comprises an assembly for guidance by rolling on the lower end of the bundle casing of the steam generator.

11 Claims, 6 Drawing Sheets

MOVABLE CARRIER DEVICE FOR CONDUCTING ATTENDANCE WORK IN THE SECONDARY PART OF A STEAM GENERATOR OF A PRESSURIZED-WATER NUCLEAR REACTOR

FIELD OF THE INVENTION

The invention relates to a movable carrier device for conducting televisual inspection operations and/or attendance work in the secondary part of a steam generator for a pressurized-water nuclear reactor.

BACKGROUND OF THE INVENTION

The steam generators of pressurized-water nuclear reactors comprise an outer casing of generally cylindrical shape which contains a bundle of tubes bent in the form of a U and embedded at their ends in a tube plate constituting the exchange part of the bundle. The tube plate is connected to the outer casing and separates the internal volume of the steam generator into a primary part delimited by a water box of generally hemispherical shape located underneath the tube plate and communicating with the internal volume of the tubes of the bundle and a secondary part comprising the internal volume of the outer casing which is located above the tube plate and in which the bundle of tubes is arranged.

A first exchange fluid consisting of the primary water ensuring the cooling of the reactor core is introduced into a first part of the water box, circulates inside the tubes of the bundle and is then recovered in a second part of the water box, before being discharged outside the steam generator and then reintroduced into the vessel of the nuclear reactor.

A second exchange fluid consisting of the feed water is introduced into the secondary part of the steam generator, in which this feed water comes into thermal contact with the primary fluid via the walls of the tubes of the bundle. The thermal exchange with the primary fluid ensures the heating and evaporation of the feed water, and the steam produced is dried and then discharged at the upper end of the secondary part of the steam generator.

After the steam generator has been in operation for some time, it may be necessary to conduct checks, maintenance operations or repairs in the secondary part of the steam generator, for example between the tubes of the bundle.

The bundle of tubes in the steam generator is arranged inside a bundle casing placed coaxially within the outer casing of the steam generator substantially over the entire height of the bundle and comprising a lower end located at some distance above the tube plate of the steam generator.

The zone of the secondary part of the steam generator in which the bundle is arranged is therefore accessible by way of the lower end of the bundle casing, an inspection or attendance device being introduced into the space provided between the lower end of the bundle casing and the tube plate.

In order to conduct inspections or attendance work in the entire zone of the secondary part of the steam generator containing the bundle, the inspection device or attendance tool must be displaceable particularly in circumferential directions in relation to the outer casing and to the bundle casing.

The bundle casing has a diameter substantially smaller than the inside diameter of the outer casing, and therefore an annular space remains between these two casings over the entire height of the bundle. This annular space opens into the inner part of the casing of the bundle in its lower part.

Inspection of the secondary part of the steam generator may involve inspection of the outer surface of the tubes by means of a televisual device, in order to evaluate their appearance and state, after the steam generator has been in operation for a particular time, in the course of which some damage to the tubes of the bundle may have occurred, for example under the effect of corrosion by the feed water or as a result of contact with foreign bodies.

The attendance work in the steam generator may involve extracting foreign bodies which have lodged between the tubes of the bundle.

To date, no simple device has been known for displacing televisual inspection or attendance means in the lower secondary part of a steam generator containing the tube bundle of the generator.

SUMMARY OF THE INVENTION

It is an object of the invention, to provide a movable carrier device for conducting televisual inspection operations and attendance work in the secondary part of a steam generator comprising an outer casing of generally cylindrical shape, through which at least one orifice or handhole passes, a bundle of exchange tubes fastened at their ends in a tube plate separating the internal volume of the steam generator into a primary part communicating with the inner space of the tubes and a secondary part containing the bundle of tubes, and a bundle casing which is arranged around the bundle coaxially within the outer casing and of which one end located in the vicinity of the tube plate is spaced some distance from the latter, the movable carrier being displaced in an annular space provided between the bundle casing and the outer casing, this carrier device making it possible to carry out attendance work at any point of the lower secondary part of the steam generator in the vicinity of the tube plate and being displaceable in a simple way and according to an easily automatable procedure.

To achieve this and, the carrier device according to the invention comprises:

a central body carrying a flexible head connected to inflation means making it possible to cause the head to change from a contracted state, in which the head can be displaced in the annular space between the bundle casing and the outer casing, to an expanded state, in which the head is retained by wedging at a location of the annular space, two jacks which are carried by the central body and the rods of which each carry at their ends an inflatable flexible head connected to inflation and deflation means making it possible to maintain the head at a location of the annular space or, on the contrary, to displace it in the annular space, the rods being oriented in two directions located on either side of the central body for the displacement of the central body of the carrier in a circumferential direction of the annular space as a result of the successive retraction and extension of each of the jack rods, and an assembly for guiding the carrier in a circumferential direction of the annular space, comprising two flexible arms connected to the central body at one of their ends and carrying at least one rolling means at their other end.

BRIEF DESCRIPTION OF THE DRAWINGS

To facilitate comprehension of the invention, a carrier device according to the invention will now be described by way of example in a plurality of embodiments with reference to the accompanying drawings.

DESCRIPTION OF THE PREFERRED EMBODIMENTS

Figure 1:
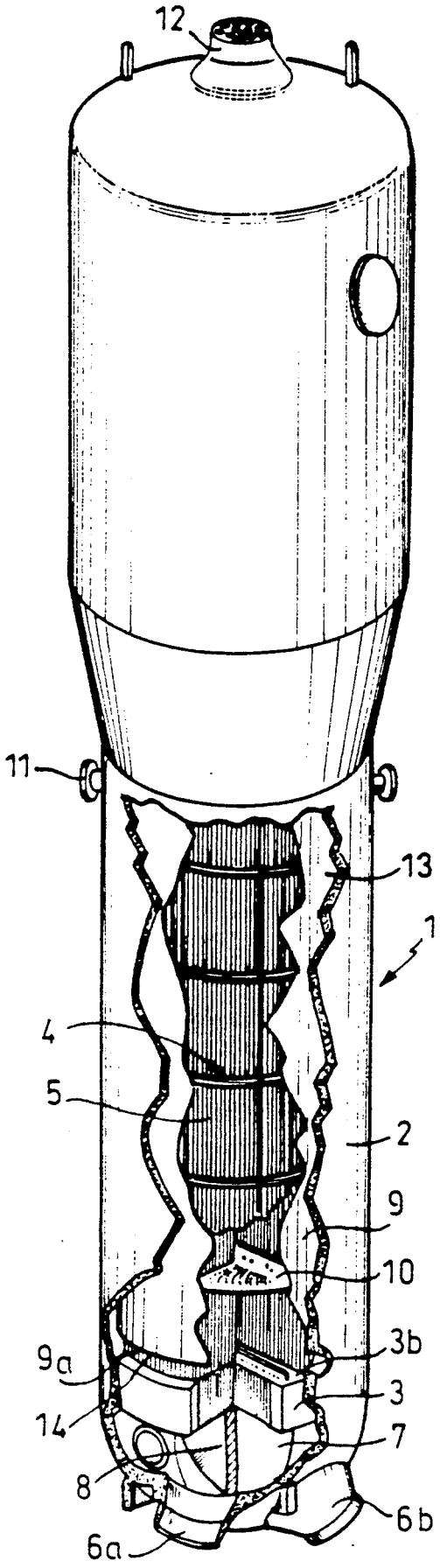
FIG. 1 is a perspective view of a steam generator of a pressurized-water nuclear reactor.

FIG. 1 shows a steam generator 1, comprising an outer casing 2 of generally cylindrical shape, the upper part of which has a larger diameter than the lower part, a tube plate 3, in which the end parts of tubes 5 of the bundle 4 of the steam generator are fastened, and a water box 7 delimited by a hemispherical casing, through which connection pieces 6*a* and 6*b* pass on either side of a partition 8 separating the water box 7 into two parts.

The tube plate 3 is fastened to the lower part of the outer casing 2 which delimits the secondary part of the steam generator containing the bundle 4.

The hemispherical casing of the water box 7 is fastened under the tube plate and constitutes the primary part of the steam generator communicating with the inner space of the tubes 5 of the bundle 4.

The bundle 4 is located inside a bundle casing 9 placed coaxially within the outer casing 2. Feed water is introduced into the secondary part of the steam generator by way of a connection piece 11 passing through the outer casing 2 above the upper part of the bundle 4.

The feed water entering by way of the connection piece 11 circulates in an annular space 13 provided between the outer casing 2 and the bundle casing 9, so as to arrive at the lower part of the bundle casing 9 located above and at some distance from the upper face of the tube plate 3. The feed water penetrates into the bundle casing by way of the orifice formed between the lower end of the bundle casing 9 and the tube plate 3 and putting the annular space 13 in communication with the internal volume of the bundle casing 9.

The feed water comes into contact with the tubes 5, heat up in contact with the tubes in which the primary water circulates, and circulates in the vertical direction from the bottom within the bundle casing and in contact with the tubes 5. The heat exchange between the primary water and the feed water via the walls of the tubes 5 ensures the heating and then evaporation of the feed water, the steam formed being dried in the part of the steam generator located above the bundle 4 and then being discharged by way of the connection piece 12 located at the upper end of the casing 2 of the steam generator.

Each of the tubes 5 of the bundle 4 communicates with a first part of the water box 7 at one of its ends and with a second part of the water box at its other end. This ensures circulation of the primary water within the tubes of the bundle.

The tubes 5 of the bundle 4, which are bent in the form of a U in their upper part and which are held by horizontal spacer plates 10 uniformly spaced over the height of the bundle, are arranged in such a way as to form vertical parallel rows and a regular network of circular cross-section in the horizontally directed transverse planes.

The bundle as a whole has the form of a volume rotationally symmetrical about the vertical axis of the steam generator, delimited in its upper part by a hemispherical surface.

Figure 2:
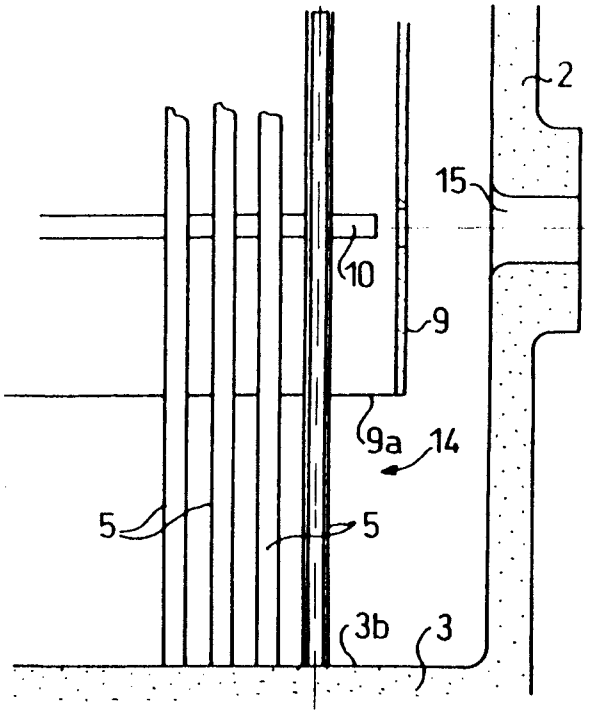
FIG. 2 is a detail view on a larger scale of part of the steam generator illustrated in FIG. 1.

As can be seen in FIG. 2, a small-size orifice 15 or handhole passes through the outer casing 2 of the steam generator in the lower part of the annular space 13 provided between the bundle casing 9 and the outer casing 2.

The carrier device according to the invention, which will be described hereinafter, makes it possible to displace a televisual inspection means or a tool along the entire circumference of the bundle 4, for example in order to conduct a check or an examination of the part of the tubes 5 which is located between the lower end of the bundle casing 9 and the upper face 3*b* of the tube plate 3.

This examination of a part of the tubes which is liable to experience severe corrosion as a result of the accumulation of chemical compounds above the tube plate can be carried out by way of the annular orifice 14 putting the annular space 13 in communication with the internal volume of the bundle casing 9.

The means for carrying out attendance work inside the steam generator have to be introduced by way of the handhole 15 passing through the outer casing 2.

Figure 3:
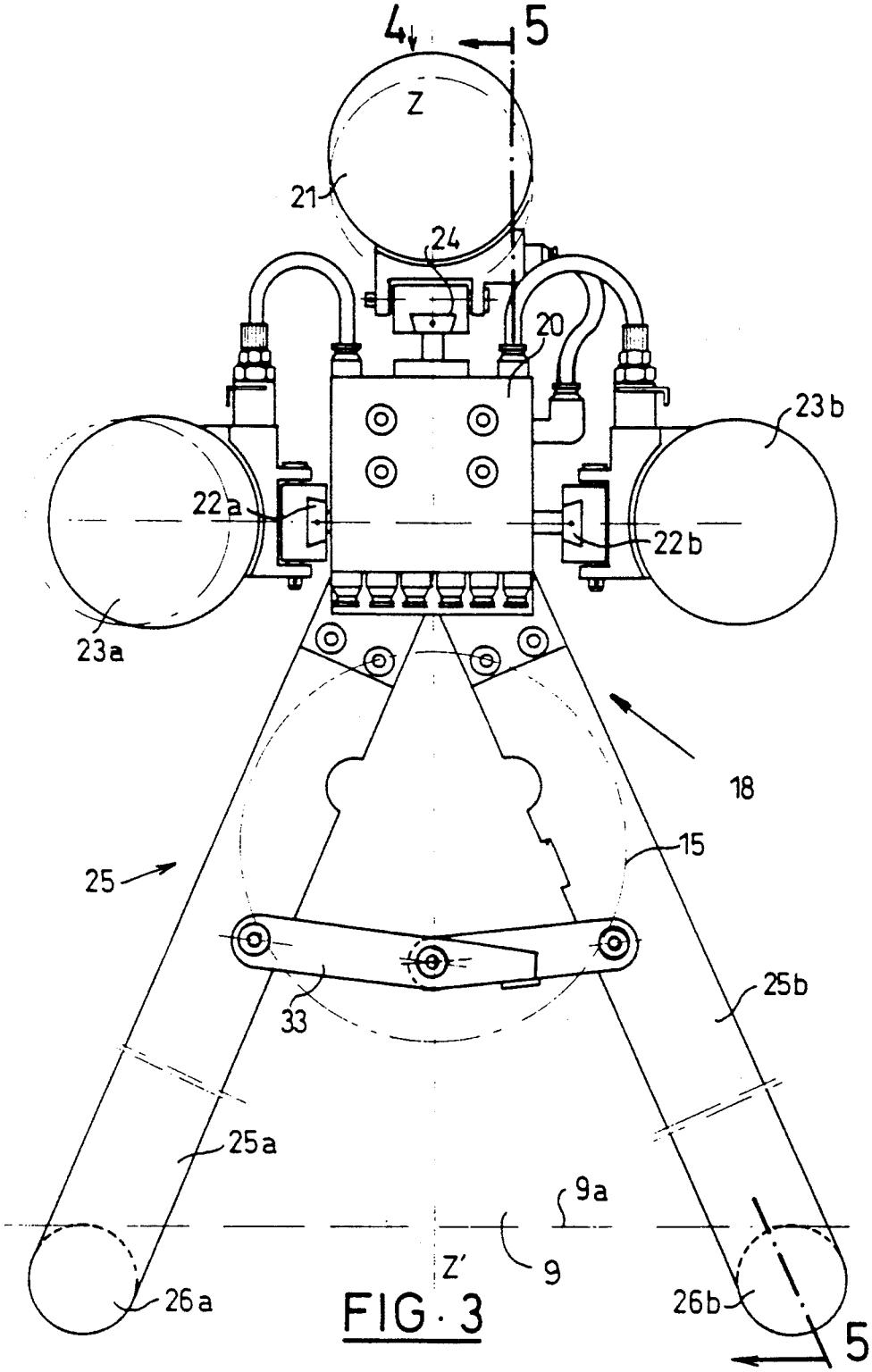
FIG. 3 is an elevation view of a second embodiment of a carrier device according to the invention.

FIG. 3 shows a first embodiment of movable carrier device according to the invention in a first alternative embodiment.

The carrier device 18, has been shown inside the secondary part of a steam generator which is represented schematically by the lower edge 9*a* of the bundle casing 9 and by the inspection orifice or handhole 15.

The device 18 comprises a central body 20 carrying a fastening head 21 consisting of an inflatable flexible envelope in two parts of substantially cylindrical shape, and two jacks 22*a*, 22*b* placed in transverse arrangements on either side of the central body 20 and each carrying a respective inflatable flexible head 23*a*, 23*b*.

The inflatable flexible head 21 placed in a central location in relation to the heads 23*a* and 23*b* is carried by a jack 24, the rod of which is perpendicular to the rods of the jacks 22*a* and 22*b*.

Figure 4:
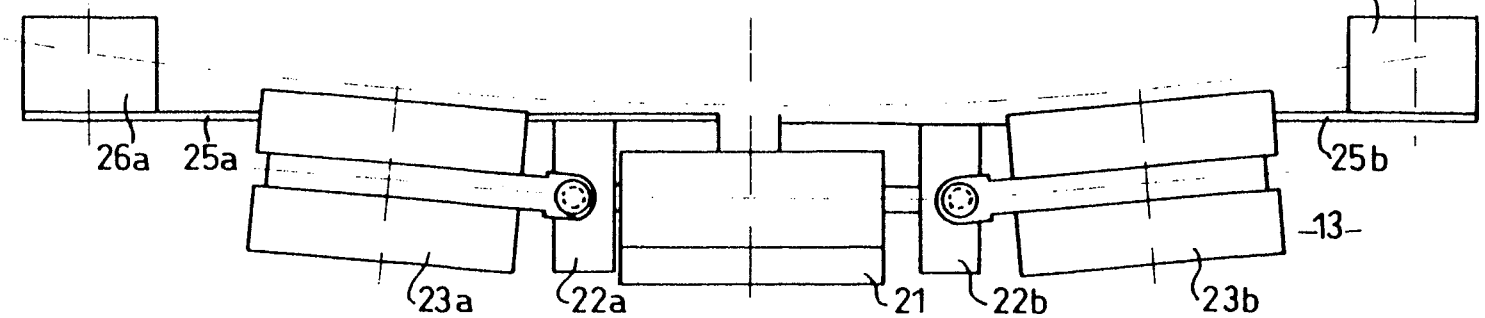
FIG. 4 is a top plan view in the direction of arrow 4 of FIG. 3.

When the device 18 is in position inside the secondary part of a steam generator in the annular space 13 between the bundle casing and the outer casing, the rod of the jack 24 extends vertically and the rods of the jacks 22*a* and 22*b* extend horizontally and are inclined slightly relative to one another, as can be seen in FIG. 4.

The central body 20 also carries, opposite to the jack 24 and to the flexible head 21, a guide assembly 25 comprising two arms 25*a* and 25*b* consisting of flexible metal leaves, such as spring leaves, fastened in a position inclined relative to the central axis 22' of the carrier, on either side of this central axis which is vertical when the carrier device 18 is in operation inside the steam generator.

Figure 5:
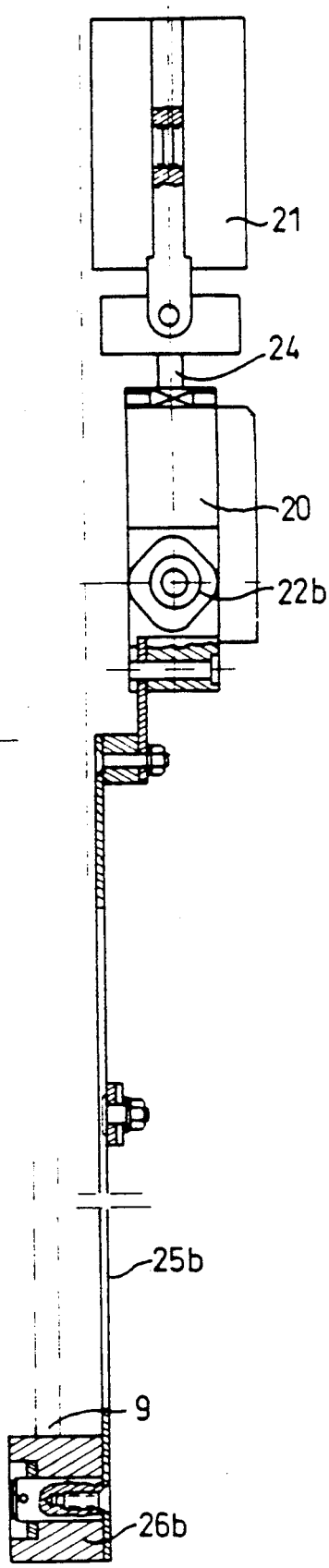
FIG. 5 is a partially sectional elevation view along line 5—5 of FIG. 3.

Each of the arms 25*a* and 25*b* carries, at its end opposite its fastening on the central body 20, a roller 26*a* (or 26*b*) mounted rotatably at the end of the corresponding arm and bearing against the lower edge 9*a* of the bundle casing 9, as can be seen in FIG. 5.

Figure 6:
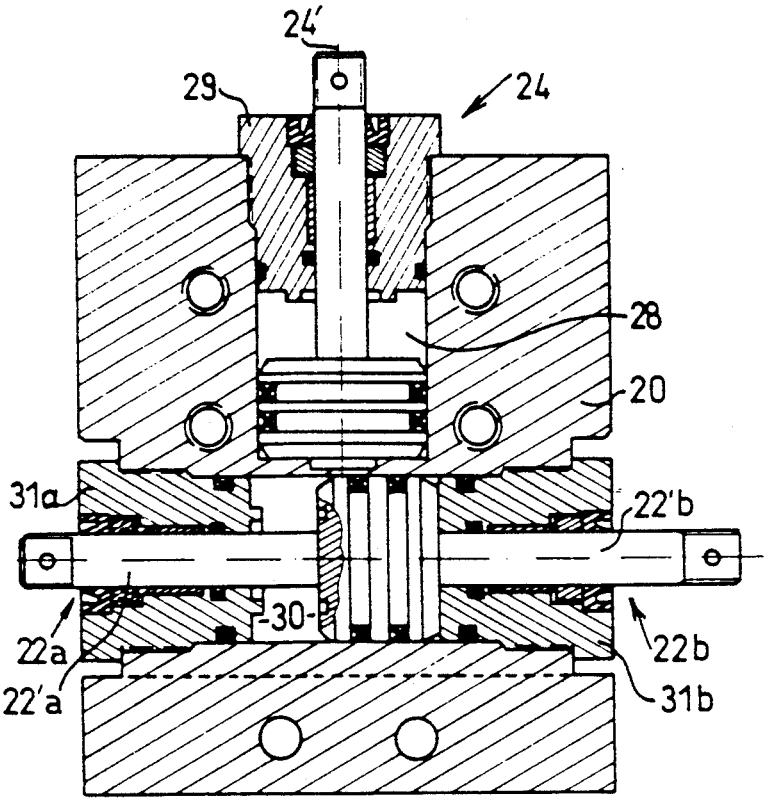
FIG. 6 is a sectional view, taken in a vertical plane, of the central body of the device illustrated in FIG. 3, comprising the jacks for displacement of the carrier.

As can be seen in FIG. 6, the jacks 23*a*, 23*b* and 24 are integrated in the central body 20 which comprises a first chamber 28 of vertical axis, in which the piston 24' of the jack 24 is mounted and which is closed by means of a piece 29 screwed into the central body 20 and having a gasket. The rod of the piston 24' of the jack 24 is mounted vertically slidably and sealingly on the inside of the piece 29.

The central body 20 comprises a second chamber 30 of horizontal axis, in which the pistons 22'*a* and 22'*b* of the jacks 22*a* and 22*b* are mounted slidably and which is closed at it ends by means of closing pieces 31*a* and 31*b*, in which the rod of the jack 22*a* and the rod of the jack 22*b* are respectively mounted sealingly slidably.

The jacks 22*a* and 22*b* constitute a double jack, the pistons and rods of which are displaced in opposite directions when the double jack is supplied with hydraulic fluid.

The rods of the jacks are displaced with to the right, in which case the rod of the jack 22*a* assumes a retracted position and the rod of the jack 22*b* an extended position, or to the left, in which case the rod of the jack 22*a* assumes an extended position and the rod of the jack 22*b* a retracted position. As will be explained later, the mutually opposed displacement of the two jacks makes it possible to obtain the displacement of the carrier in a circumferential direction of the annular space of the steam generator.

The rod of the jack 24 is displaced between an extended high position and a retracted low position.

The flexible envelopes 21, 23*a* and 23*b*, which can be fastened removably to the end of the rods of the jacks 22*a*, 22*b* and 24 by means of a dovetail joint, comprise a support allowing articulated mounting on the rod of the corresponding jack.

The envelope 21 is mounted on the rod of the jack 24 in an articulated manner about an axis having a first direction, and the envelopes 23*a* and 23*b* are mounted on the rods of the respective jacks 22*a* and 22*b* in an articulated manner about an axis having a second direction perpendicular to the first.

When the carrier device is in place in the annular space of the steam generator, as shown in FIG. 3, the first direction is horizontal and the second direction is vertical.

Each of the envelopes 21, 23*a* and 23*b* is produced in double form and comprises two compartments of cylindrical shape constituting balloons inflatable by means of solenoid valves and of a compressed-air supply circuit.

The arms 25*a* and 25*b* constituting the means for guiding the carrier on the lower end of the bundle casing consist of flexible metal leaves which are mounted in an articulated manner on the body 20 so as to form a compass mechanism which can be in the open position, as shown in FIG. 3, or in the closed position.

In the open position of the compass mechanism, the arms 25*a* and 25*b* are spaced apart and form a particular angle, so that the guide rollers 26*a* and 26*b* are spaced at some distance from one another.

The arms 25*a* and 25*b* are maintained in this spaced-apart position by an assembly 33 of two links on one another and articulated on the arms 25*a* and 25*b*.

In the folded-up position of the compass mechanism, the arms 25*a* and 25*b* are parallel and laid against one another.

Reference will now be made to FIGS. 3 to 6 as a whole in order to describe the operation of the movable carrier device according to the invention.

To put the carrier in place in the steam generator, the flexible envelope 21 is introduced in the contracted state into the annular space 13 of the steam generator by way of the handhole 15.

The envelope 21 is placed in a position located above the handhole 15 and inflated by means of compressed air, thus ensuring that it expands and is fastened in place by wedging in the annular space 13.

The central body 20 and the guide means consisting of the arms 25*a* and 25*b* are then introduced into the annular space of the steam generator by way of the handhole 15.

To carry out this introduction of the central body and of the arms 25*a* and 25*b*, the arms 25*a* and 25*b* are placed in their folded position, thus allowing them to be introduced in the vertical direction by way of the handhole by utilizing the flexibility of the spring leaves forming these arms.

The arms 25*a* and 25*b* and the central body 20 of the carrier are engaged into the handhole by downward displacement in the vertical direction.

The envelopes 23*a* and 23*b* are fastened to the ends of the rods of the respective jacks 22*a* and 22*b* in succession and level with the handhole 15 by means of their support. The connections of the fluid circuits between the inflatable envelopes and the central body are made.

The whole of the central body 20, of the guide device 25 and of the flexible envelopes 23*a* and 23*b* is then displaced upwards, so as to carry out the fastening of the central body 20 on the support of the envelope 21 by means of the rod of the jack 24, the opening of the arms 25*a* and 25*b* and then the blocking in the open position by means of the links 33.

The jack 24 is actuated so as to exert a pull upwards in the vertical direction on the central body 20 and to bring the guide rollers 26*a* and 26*b* to bear on the lower edge 9*a* of the bundle casing 9.

The envelopes 23*a* and 23*b* are then displaced simultaneously to the right or to the left, depending on the direction of displacement desired for the carrier, by use of the double jack 22*a*, 22*b*.

During this displacement, the envelopes 23*a* and 23*b* are in their contracted state.

The envelopes 23*a* and 23*b* are then supplied with compressed air, so as to ensure the inflation of the envelopes and the wedging of these in the annular space 13 between the bundle casing and the outer casing of the steam generator.

The flexible envelope 21 is then put into its contracted position by the discharge of the compressed air which it contained.

The double jack 22*a*, 22*b* is fed in the opposite direction to the preceding one, thereby causing a displacement of the carrier as a whole either to the right or to the left, depending on the desired direction of displacement, in relation to the envelopes 23*a* and 23*b* and to the rods of the jacks 22*a* and 22*b* which are maintained in a position fixed relative to the steam generator.

The movable carrier can thus be displaced one step in the circumferential direction of the steam generator in one direction or the other.

The next displacement step will be carried out by obtaining the inflation and wedging of the flexible envelope 21, then the deflation and displacement of the envelopes 23*a* and 23*b* in the desired direction, the inflation of these envelopes in their new position, and finally the displacement of the central body 20 by the feed of the double jack. Between two advancing steps, it is possible to raise the central body by means of the jack 24 so as to lay the rollers 26 against the bottom of the bundle casing 9.

As can be seen in FIG. 4, during the circumferential displacements of the carrier, the articulated mounting of the lateral envelopes 23*a* and 23*b* about the vertical axes makes it possible to follow the curvature of the annular space 13 of the steam generator.

As a result of successive displacements controlled remotely by hydraulic and pneumatic means, the carrier and therefore the tool or inspection device fastened to this carrier can be arranged in any circumferential position in relation to the tube bundle of the steam generator.

It is consequently possible to conduct a televisual inspection or attendance work in any zone of the periphery of the bundle.

The inspection means or the tool is introduced into the zone occupied by the bundle by way of the annular orifice 14 located between the lower end 9*a* of the bundle casing 9 and the tube plate 3.

Figure 8:
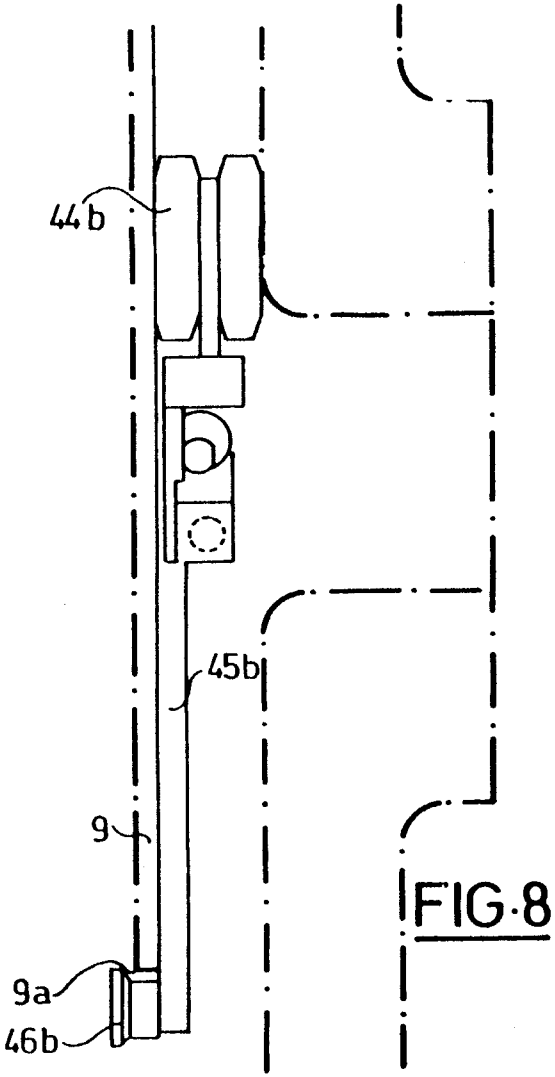
FIG. 8 is a side elevation view in the direction of arrow 8 of FIG. 7.
Figure 7:
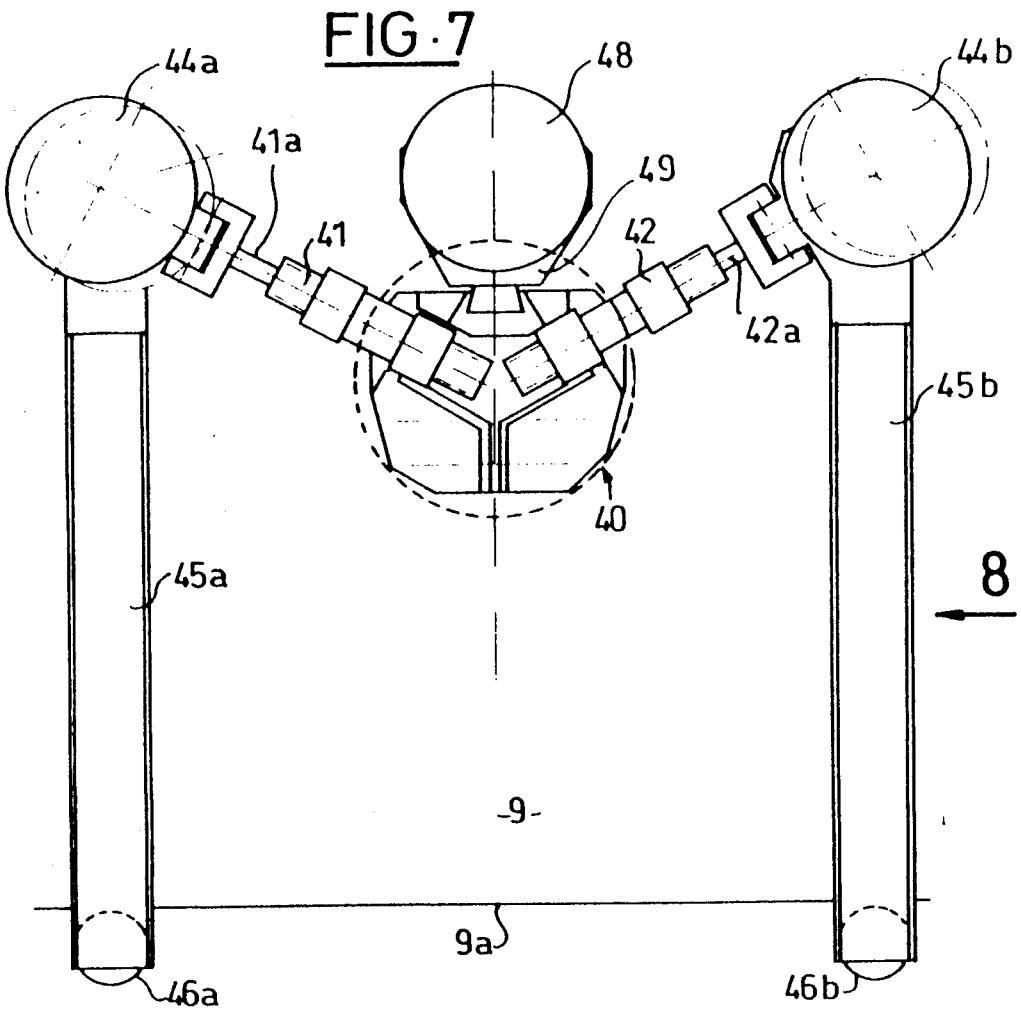
FIG. 7 is an elevation view of a third embodiment of a movable carrier according to the invention.
Figure 9:
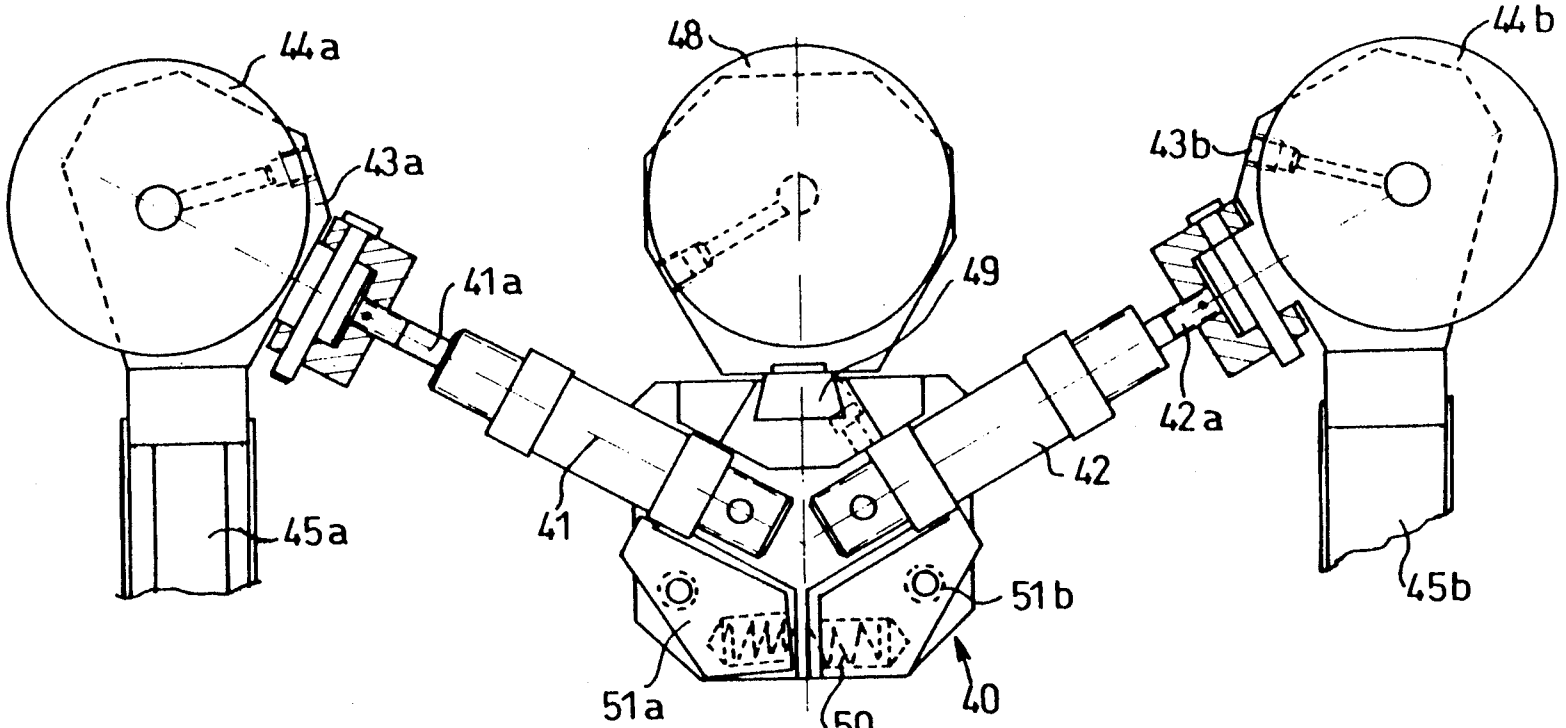
FIG. 9 is a partially sectional elevation view on a larger scale of part of the carrier device illustrated in FIG. 7.

FIGS. 7, 8 and 9 illustrate an alternative embodiment of the carrier device according to the invention.

In this version, the central body 40 carries two jack bodes 41 and 42 by means of joints and in a V-shaped arrangement, the jack bodies being inclined slightly relative to the horizontal plane and forming an angle larger than 120° with one another.

The jacks 41 and 42, which are arranged on either side of the central body 40, comprise respective rods 41*a* and 42*a* directed outwards and carrying at their end, in an articulated manner, respective supports 43*a*, 43*b* of two flexible envelopes 44*a* and 44*b*.

The supports 43*a* and 43*b* are each fixed to a guide arm 45*a*, 45*b* respectively carrying at its end a respective roller 46*a*, 46*b* intended for ensuring the guidance of the carrier on the lower edge 9*a* of the bundle casing 9.

The central body 40 likewise carries an inflatable flexible envelope 48 by means of a support 49 which can be joined removably to the carrier 40.

The jack bodes 41 and 42 mounted in an articulated manner on the central body 40 are maintained in a raised position by two supporting pieces 51*a* and 51*b* articulated on the central body 40 and maintained in a spacing-apart and raising position by a helical spring 50.

The inflatable envelopes 44*a*, 44*b* and 48 are similar to the envelopes 21, 23*a*, and 23*b* which are illustrated in FIGS. 3 and 4 and which were described above.

The operating mode of the device shown in FIGS. 7, 8 and 9 will be described hereinafter.

In a first stage, the inflatable flexible envelope 48 is introduced in the contracted and deflated state into the annular space 13 by way of the handhole 15, until it assumes a position slightly above the handhole, as shown in FIG. 7.

The flexible envelope 48 is then expanded by inflation with compressed air, thus ensuring that it is wedged in the annular space 13 in the position shown.

The central body 40 is then put in place and joined to the support of the flexible envelope 48 by means of a dovetail joint.

The flexible envelope 48 is then deflated, and the whole of the flexible envelope 48 and of the central body 40 is displaced manually either to the right or to the left, in order to free the handhole 15, while at the same time leaving the lateral part of the central body 40 having one of the jack supports 51*a* or 51*b* accessible.

The flexible envelope 48 is then expanded by inflation with compressed air. The introduction of an assembly consisting of a jack 41 or 42, of an inflatable envelope 44*a* or 44*b* and of a guide arm 45*a* or 45*b* carrying a roller 46*a* or 46*b* into the annular space 13 of the steam generator by way of the handhole 15 is carried out.

The flexible envelope 44*a* or 44*b* is in the contracted and deflated state during this introduction operation. The assembly consisting of the jack, the flexible envelope and the guide arm is then fixed on the central body 40 and the corresponding support 51*a* or 51*b*.

The newly formed assembly is then displaced in the direction opposite to the preceding one, after the flexible envelope 48 has been deflated, so as to free the entrance of the handhole 15.

The second assembly consisting of a jack, of a flexible envelope 44*a* or 44*b* and of a guide means 45*a* or 45*b* is assembled together.

This installation is made easier by the fast that the arms 45*a* and 45*b* consist of spring leaves.

The rollers 46*a* and 46*b* are then brought into contact with the lower edge 9*a* of the bundle casing 9 by simultaneous actuation of the jacks 41 and 42 in opposite directions, the flexible envelopes 44*a* and 44*b* being in the deflated state.

The supporting pieces 51*a* and 51*b* make it possible to carry out the raising of the jack bodies, of the envelope supports and of the arms 45*a* and 45*b* as a result of the action of the helical spring 50.

The displacement of the carrier in the circumferential direction is obtained by putting the flexible envelopes 44*a* and 44*b* into their expanded state and the central flexible envelope 48 into the contracted and deflated state.

Simultaneous actuation of the jacks 41 and 42 in opposite directions ensures circumferential displacement of the central body 40 in relation to the envelopes 44*a* and 44*b* maintained in a fixed position by wedging inside the annular space.

The displacement of the central body 40 can be carried out in one direction or the other, depending on which jack is extended and which jack is retracted.

The expansion of the central flexible envelope 48 by inflation and the contraction of the lateral flexible envelopes 44*a* and 44*b* by deflation are then carried out.

The two jacks 41 and 42 can then be actuated simultaneously in the direction opposite to the preceding one, so as to return them to the initial position in order to execute a new displacement step.

As before, therefore, it is possible to obtain any circumferential position of the carrier around the bundle as a result of a displacement in successive steps which is controlled remotely by hydraulic and pneumatic means.

During all these displacements, the carrier is guided by the rollers which are maintained in contact with the lower end of the casing of the bundle and which are displaced on the latter.

At all events, it is possible to displace the carrier in a fully automated way on the inside of steam generators, in order to conduct a check or attendance work in any part of the bundle of the steam generator.

The central body, the actuating jacks and the deformable flexible envelopes may have forms and arrangements different from those described as examples.

Likewise, the guide assembly of the carrier can be produced in a different form.

The rolling means of this guide assembly can be displaced not only on the lower end of the bundle casing, but also by bearing on the tube plate.

Finally, the carrier device according to the invention can be used in any steam generator comprising a bundle surrounded by a bundle casing arranged coaxially so as to provide an annular space located between the bundle casing and the outer casing.

I claim:

1. Device for conducting an inspection operation and attendance work in the secondary part of a steam generator of a nuclear reactor, said steam generator comprising an outer casing of generally cylindrical shape comprising at least one orifice, a number of exchange tubes having ends fastened in a tube plate separating an internal volume of the steam generator into a primary part communicating with inner space of the tubes and a secondary part containing the bundle of tubes, and a bundle casing which is arranged around the bundle coaxially within the outer casing, said bundle casing having one end located in the vicinity of the tube plate at a distance from said tube plate, the movable carrier being displaced in an annular space provided between the bundle casing and the outer casing, said device comprising:

(a) a central body carrying a first flexible head connected to inflation means for causing the head to change from a contracted state, in which the head can be displaced in the annular space between the bundle casing and the outer casing, to an expanded state, in which the head is retained by wedging at a location of the annular space;

(b) two jacks carried by the central body and having rods each of which carries at its end an inflatable flexible head connected to inflation and deflation means making it possible selectively to maintain the head at a location of the annular space and to displace said head in the annular space, the rods of the jacks being oriented in two directions located on either side of the central body of the carrier circumferentially of the annular space as a result of the successive retraction and extension of each of the jack rods; and (c) an assembly for guiding the carrier circumferentially of the annular space, said assembly comprising two flexible arms each connected to the central body at one of its ends and carrying at least one rolling means at its other end.

2. Device according to claim 1, wherein the two rods and pistons of the two jacks are mounted movably in a chamber inside the central body, in such a way that these two rods and pistons are displaced in the same direction and oppositely to one another within the chamber.

3. Device according to claim 2, wherein the central body comprises a second chamber having an axis perpendicular to the axis of the first chamber and in which is mounted movably a piston/rod assembly of a jack, to which is connected the inflatable flexible head carried by the central body.

4. Device according to claim 1, wherein the first inflatable flexible head carried by the central body is connected removably to the central body, and the inflatable flexible heads carried by the rods of the jacks are connected to these rods removably and in an articulated manner.

5. Device according to any one of claims 2 to 4, wherein the guide assembly of the carrier has the form of a compass mechanism comprising branches consisting of flexible metal leaves mounted at one of their ends on the central body in an articulated manner and movable between a folded position and a spaced-apart position, in which the branches can be maintained by means of a link assembly.

6. Device according to claim 1, wherein the jacks are fastened in an articulated manner to the central body in a V-shaped arrangement on either side of the central body and comprise rods, at the end of each of which is mounted removably an assembly comprising an inflatable flexible head and a supporting arm carrying a bearing roller at its end opposite the head.

7. Device according to claim 6, wherein the arms consist of flexible metal leaves.

8. Device according to claim 6, wherein the inflatable head carried by the central body is connected to the central body by removable connection means.

9. Device according to claim 6. wherein the jacks bear on supports mounted in an articulated manner on the central body and maintained in a position maintaining the jacks by means of at least one helical spring.

10. Device according to claim 6, wherein the rolling means of the guide assembly is displaced on the lower end of the bundle casing.

11. Device according to claim 6, wherein the rolling means of the guide assembly is displaced by bearing on the tube plate.

* * * * *